US005148222A

United States Patent [19]

Lior et al.

[11] Patent Number: 5,148,222

[45] Date of Patent: Sep. 15, 1992

[54] LIQUID DEVELOPER SYSTEM

[75] Inventors: Ishaiau Lior, Nes Ziona; Itzhak Ashkenazi, Gibton, both of Israel

[73] Assignee: Spectrum Sciences B.V., Wassenaar, Netherlands

[21] Appl. No.: 570,776

[22] Filed: Aug. 22, 1990

[51] Int. Cl.[5] ..... G03G 15/10

[52] U.S. Cl. ..... 355/256; 118/645; 118/659; 355/326

[58] Field of Search ..... 118/645, 647, 651, 659, 118/661; 355/256, 259, 261, 326, 327

[56] References Cited

U.S. PATENT DOCUMENTS

| | | | |
|---|---|---|---|
| 3,405,683 | 10/1968 | Jons et al. | 118/659 |
| 3,669,073 | 6/1972 | Savit et al. | 355/256 X |
| 3,839,071 | 10/1974 | Borelli et al. | 118/645 X |
| 3,867,708 | 2/1975 | Bretting | 330/4.6 |
| 3,900,003 | 8/1975 | Sato et al. | 118/645 |
| 3,910,231 | 10/1975 | Inoue et al. | 355/326 X |
| 3,921,580 | 11/1975 | Kase | 355/257 X |
| 4,073,266 | 2/1978 | Arneth et al. | 118/647 |
| 4,233,385 | 11/1980 | Hinz et al. | 118/659 X |
| 4,342,823 | 8/1982 | Grant et al. | 355/256 X |
| 4,400,079 | 8/1983 | Landa | 355/256 |
| 4,421,056 | 12/1983 | Schinke | 118/645 |
| 4,439,035 | 3/1984 | Landa | 355/307 |
| 4,504,138 | 3/1985 | Kuehnle et al. | 355/256 |
| 4,522,484 | 6/1985 | Landa | 355/256 |
| 4,579,253 | 4/1986 | Shenier | 222/DIG. 1 |
| 4,640,605 | 2/1987 | Ariyama et al. | 355/327 |
| 4,690,539 | 9/1987 | Radulski et al. | 355/272 |
| 4,794,651 | 12/1988 | Landa et al. | 430/109 |
| 4,860,924 | 8/1989 | Simms et al. | 355/256 X |

FOREIGN PATENT DOCUMENTS

| | | |
|---|---|---|
| 58-2863 | 1/1983 | Japan . |
| 9014619 | 11/1990 | World Int. Prop. O. . |

OTHER PUBLICATIONS

English Language Abstract of Japanese Patent 58-2863.
International Search Report and Annex.

*Primary Examiner*—A. T. Grimley
*Assistant Examiner*—J. E. Barlow Jr.
*Attorney, Agent, or Firm*—Sandler, Greenblum, & Bernstein

[57] ABSTRACT

Liquid toner imaging apparatus including an image bearing surface, apparatus for developing an image on the image bearing surface using a liquid toner including carrier liquid and pigmented particles, and apparatus for transferring a developed image from the image bearing surface to a substrate. The apparatus for developing includes a developer electrode having a developer surface portions of which sequentially come into propinquity with the image bearing surface and subsequently leave propinquity therewith, each region forming a development region during its propinquity and a stationary nozzle for providing liquid toner of a given color to the development region by supplying liquid toner onto a portion of the developer electrode, wherein the nozzle is spaced more than 8.4 mm from any other nozzle which supplies liquid toner of the given color to the development region.

34 Claims, 5 Drawing Sheets

LIQUID DEVELOPER SYSTEM

FIELD OF THE INVENTION

The present invention relates generally to imaging systems and more particularly to liquid toner development systems.

BACKGROUND OF THE INVENTION

Proposals for various types of multicolor imaging apparatus and techniques appear in the patent literature. There is described in Japanese Patent document 58002863 to Kawamura an image recording device for use in a color printer which include nozzle heads which spray liquid coloring toner onto electrostatic latent images on the side of a photosensitive drum and thus develop images thereon. A single nozzle is provided for each color and the nozzles reciprocate along a nozzle guide. Alternating current apparatus is disposed between the nozzle and the drum in order to spread out the impingement area of the toner on the drum.

U.S. Pat. No. 4,690,539 describes transfer apparatus in which a plurality of liquid images are transferred from a photoconductive member to a copy sheet. The liquid images, which include a liquid carrier having toner particles dispersed therein, are attracted from the photoconductive member to an intermediate web. A substantial amount of the liquid carrier is removed from the intermediate web and the toner particles are secured thereon. Thereafter, another liquid image having toner particles of a different color from the toner particles of the first liquid image is attracted to the intermediate member. Once again the liquid carrier material is removed from the web and the toner particles of the second liquid image are secured thereon. Thereafter, all of the toner particles are transferred from the intermediate member to the copy sheet, in image configuration.

U.S Pat. No. 3,900,003 describes a liquid developing device for use in multicolor electrophotographic copying machines, having a plurality of feed pipes for supplying different liquid color developers to a developing station, which feed pipes are connected to a common developer supply pipe. Valves are provided in the feed pipes wherein each of the valves are actuated by an electrical signal to supply only one selected liquid color developer to the developing station at a time. The liquid developing device is also provided with a belt for removing residual liquid developer remaining on an image bearing member after development and with a plurality of blades for scraping and collecting the thus removed liquid developer, which are selected and actuated in correspondence with a selected color.

U.S. Pat. No. 4,504,138 describes a method and apparatus for developing electrostatic latent images formed on a photoconductor surface providing the steps of applying a thin viscous layer of electrically charged toner particles to an applicator roller preferably by electrically assisted separation thereof from a liquid toner suspension. A restricted passage is defined between the applicator roller and the photoconductor surface approximately the thickness of the viscous layer and the toner particles are transferred from the applicator roller to the photoconductor surface due to their preferential adherence to the photoconductor surface under the dominant influence of the electric field of the electrostatic latent image carried by the photoconductive surface.

U.S. Pat. No. 4,400,079 describes a developing system for an electrophotographic copier in which a roller having a conductive outer surface is disposed adjacent to the imaging surface to form a gap. The roller is driven at a peripheral linear velocity substantially greater than the velocity of movement of the imaging surface and is supplied with liquid developer at a location spaced from the gap to cause the roller to inject the developer into the gap. The roller is coupled to a source of electrical potential.

U.S. Pat. No. 4,342,823 describes a perforate development electrode and a method for developing electrostatic images directly on a final image bearing sheet, formed of electrophotographic material coated onto a substrate, by means of a perforate development electrode and liquid toner, without immersing the material in a bath of toner. The method comprises spraying liquid toner against pressure reducing means adjacent to the electrode to reduce and make uniform the pressure of the flowing liquid toner and flowing the liquid toner uniformly over and through the perforate development electrode and over the image side of the sheet without contacting the side opposite the image side with the toner.

U.S. Pat. No. 4,233,385 describes a method of liquid development of charge images formed on a surface of a tape-like record carrier, for example by an electrostatic printer. The record carrier is simultaneously sprayed with developer liquid in two flows which are directed towards each other. As a result two separate, uniform and oppositely directed flow zones meeting at one common turbulent flow zone are obtained. Both during pre-development and final development the charge images are brought into contact with a large quantity of fresh developer liquid.

U.S. Pat. No. 4,073,266 describes apparatus for developing a latent electrostatic image on an electrophotographic copying material by means of a toner dispersion. An infeed roller applies the toner dispersion to the copying material and downstream thereof, a distribution roller acts on the surface of the copying material. Squeegee rollers downstream of the distribution roller effect removal of unused toner. Toner which adheres to the distribution roller during application of voltage thereto is sprayed off and recovered for recycling, the spraying agent being toner dispersion.

U.S. Pat. No. 3,405,683 describes apparatus for the development of latent electrostatic images on an electrophotographic material with a liquid developer which includes means to feed the electrophotographic material through a pair of rotatable nip rolls and nozzle means adapted to simultaneously spray the electrostatic image and the nip roll which contacts the latent image.

U.S. Pat. No. 3,867,708 describes a liquid toner system for developing an electrostatic image on a substrate in which liquid toner is supplied to a developer roller along its length by means of a header tube disposed parallel to the developer roller and having a plurality of feed holes along its length.

U.S. Pat. No. 4,522,484 describes a two stage development system. In the first stage a weak latent image on a photoconductor is developed by pumping liquid developer through a nozzle stated to be adapted to discharge the developer between the photoconductor and a reverse roller. The roller is biased to a potential greater than that of the background regions of the weak image and below that of the image regions of the weak image.

SUMMARY OF THE INVENTION

It is an object of the present invention to provide a simplified liquid toner development system especially adapted for multi-color electrophotographic imaging systems.

There is therefore provided, in a preferred embodiment of the invention, liquid toner imaging apparatus including an image bearing surface, apparatus for developing an image on the image bearing surface using a liquid toner including carrier liquid and pigmented particles, and apparatus for transferring a developed image from the image bearing surface to a substrate, wherein the apparatus for developing includes a developer electrode having a developer surface portions of which sequentially come into propinquity with the image bearing surface and subsequently go out of propinquity therewith, each portion forming a development region during its propinquity, and a stationary nozzle for providing liquid toner of a given color to the development region by supplying liquid toner onto a portion of the developer electrode, wherein the nozzle is spaced at least 8.4 mm from any other nozzle which supplies liquid toner of the given color to the development region.

In a preferred embodiment of the invention the nozzle supplies the liquid toner to a portion of the developer surface after it leaves the development region. In a preferred embodiment of the invention only a single stationary nozzle is provided for supplying liquid toner of a given color.

In a preferred embodiment of the invention the developer electrode is situated generally below the image bearing surface.

In a preferred embodiment of the invention the image bearing surface moves in a given direction at the development region and the developer electrode is a rotating roller spaced from the image bearing surface, wherein the developer surface moves in a direction opposite to the given direction at the development region.

In a preferred embodiment of the invention the apparatus is a multi-color imaging system including apparatus for sequentially developing images on the image bearing surface using a plurality of liquid toners each including carrier liquid and pigmented particles of a given color and apparatus for sequentially transferring a developed image of the given color from the image bearing surface to a substrate.

In a preferred embodiment of the invention the nozzle supplies a stream of liquid toner having a component of velocity toward the development region. In a preferred embodiment of the invention the stream also has a component of velocity parallel to the development region.

There is further provided , in a preferred embodiment of the invention, liquid toner imaging apparatus including an image bearing surface, apparatus for developing an image on the image bearing surface using a liquid toner including carrier liquid and pigmented particles, and apparatus for transferring a developed image from the image bearing surface to a substrate, wherein the apparatus for developing includes a single developer electrode having a developer surface portions of which sequentially come into propinquity with the image bearing surface and subsequently go out of propinquity therewith, each portion forming a development region during its propinquity, and a stationary nozzle for providing liquid toner of a given color to the development region, wherein the nozzle is spaced at least 8.4 mm from any other nozzle which supplies liquid toner of the given color to the development region.

BRIEF DESCRIPTION OF THE DRAWINGS

The present invention will be understood and appreciated more fully from the following detailed description, taken in conjunction with the drawings in which.

DESCRIPTION OF PREFERRED EMBODIMENTS

Figure 1:
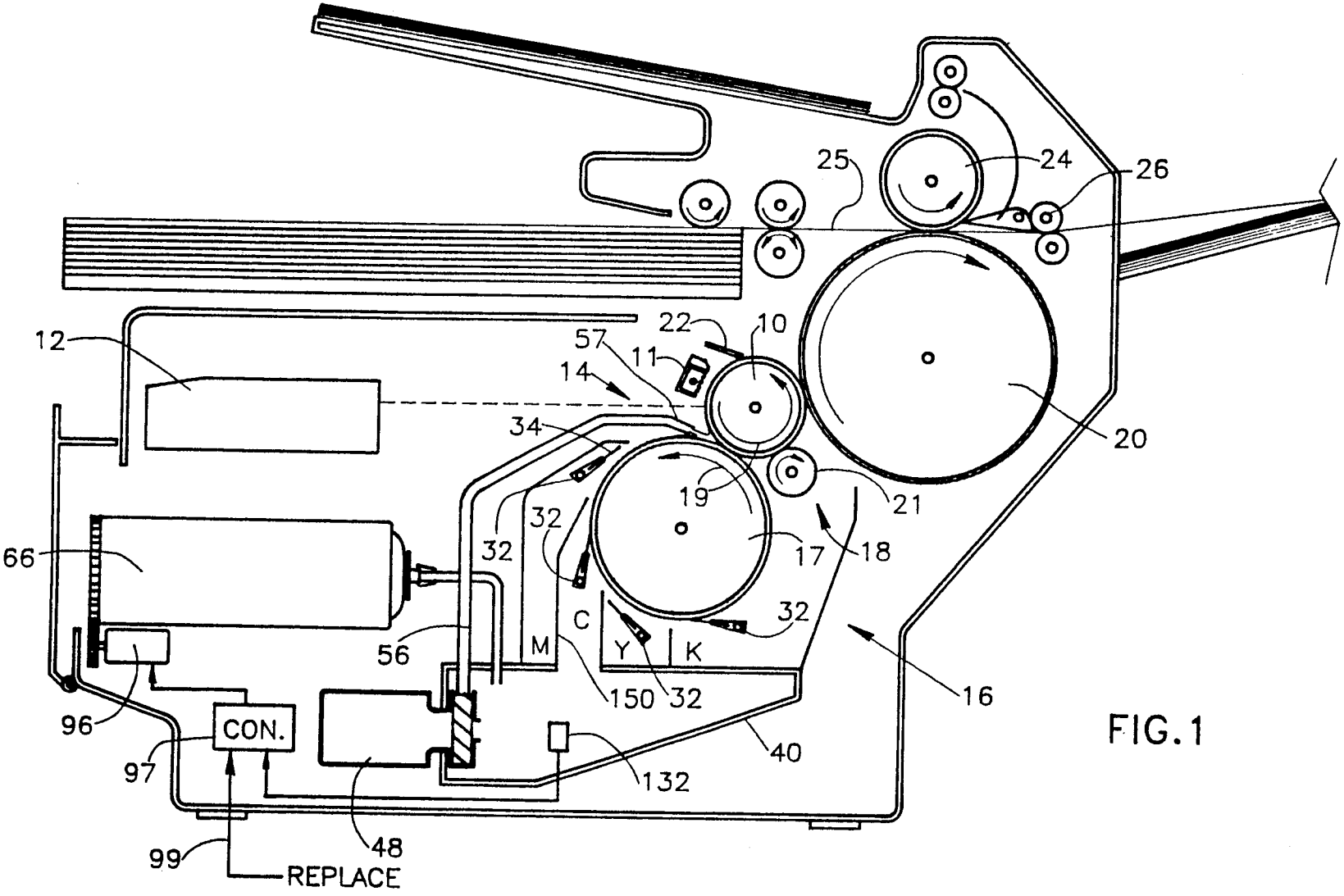
FIG. 1 is a side, partial sectional generalized illustration of multi-color imaging apparatus constructed and operative in accordance with a preferred embodiment of the present invention.

Reference is now made to FIG. 1 which illustrates a multicolor electrostatic imaging system constructed and operative in accordance with a preferred embodiment of the present invention. As seen in FIG. 1 there is provided an image bearing surface typically embodied in a rotating photoconductive drum 10. Operatively associated with photoconductive drum 10 is photoconductor charging apparatus 11 and imaging apparatus 12, for example a laser scanner, for providing a desired latent image on drum 10. The latent image normally includes image areas at a first electrical potential and background areas at another electrical potential.

Also associated with photoconductive drum 10 are a multicolor liquid developing assembly 16, an excess liquid removal assembly 18, an intermediate transfer member 20 and a resilient scraper cleaning station 22.

Developing assembly 16 preferably includes a developer roller electrode 17 spaced from photoconductive drum 10 and typically rotating in the same sense as drum 10, as indicated by arrows 19. This rotation provides for the surface of drum 10 and roller 17 to have opposite velocities in their region of propinquity. Developing assembly also includes multicolor toner supply assembly 14, for providing colored toner to develop latent images on photoconductive drum 10 and a plurality of color specific toner cleaning assemblies 32 for removal of excess toner from developer roller 17. Developing assembly 16 is described hereinbelow in greater detail.

Photoconductive drum 10, photoconductor charging apparatus 11 and imaging apparatus 12 may be any suitable drum, charging apparatus and imaging apparatus such as are well known in the art.

Excess liquid removal and image compacting assembly 18 typically includes a biased squeegee roller 21 which is urged against drum 10. Squeegee roller 21 is preferably formed of resilient conductive polymeric material, and charged to a of several hundred to a few thousand volts with the same polarity as that of the charge on the toner particles.

Intermediate transfer member 20 may be any suitable intermediate transfer member such as those described in commonly assigned U.S. patent application Ser. Nos.

306,062 filed Feb. 6, 1989, and 393,649 filed Aug. 14, 1989, the disclosures of which are incorporated herein by reference, and is arranged for electrophoretic transfer of the image thereto from the image bearing surface. Intermediate transfer member 20 is preferably associated with a pressure roller 24 for subsequent transfer of the image onto a further substrate 25, such as paper, preferably by heat and pressure. A fuser 26 may be associated with substrate 25, for fixing the image thereon, if further fixing is required.

Cleaning station 22 may be any suitable cleaning station such as the resilient blade shown in FIG. 1 or that described in U.S. Pat. No. 4,439,035, the disclosure of which is incorporated herein by reference.

In accordance with one embodiment of the invention, after development of each image in a given single color, the single color image is transferred to intermediate transfer member 20. Subsequent images in different colors are sequentially transferred onto intermediate transfer member 20. When all of the desired images have been transferred to intermediate transfer member 20, the complete multi-color image is transferred from transfer member 20 to substrate 25. Pressure roller 24 therefore produces operative engagement between intermediate transfer member 20 and substrate 25 only when transfer of the composite image to substrate 25 takes place.

Alternatively, each single color image is transferred to the paper after its formation. In this case the paper is fed through the machine once for each color or is held on a platen (not shown) and contacted with intermediate transfer member 20 during image transfer. As a further alternative, the intermediate transfer member 20 is omitted and the developed single color images are transferred sequentially directly from drum 10 to substrate 25.

Figure 2:
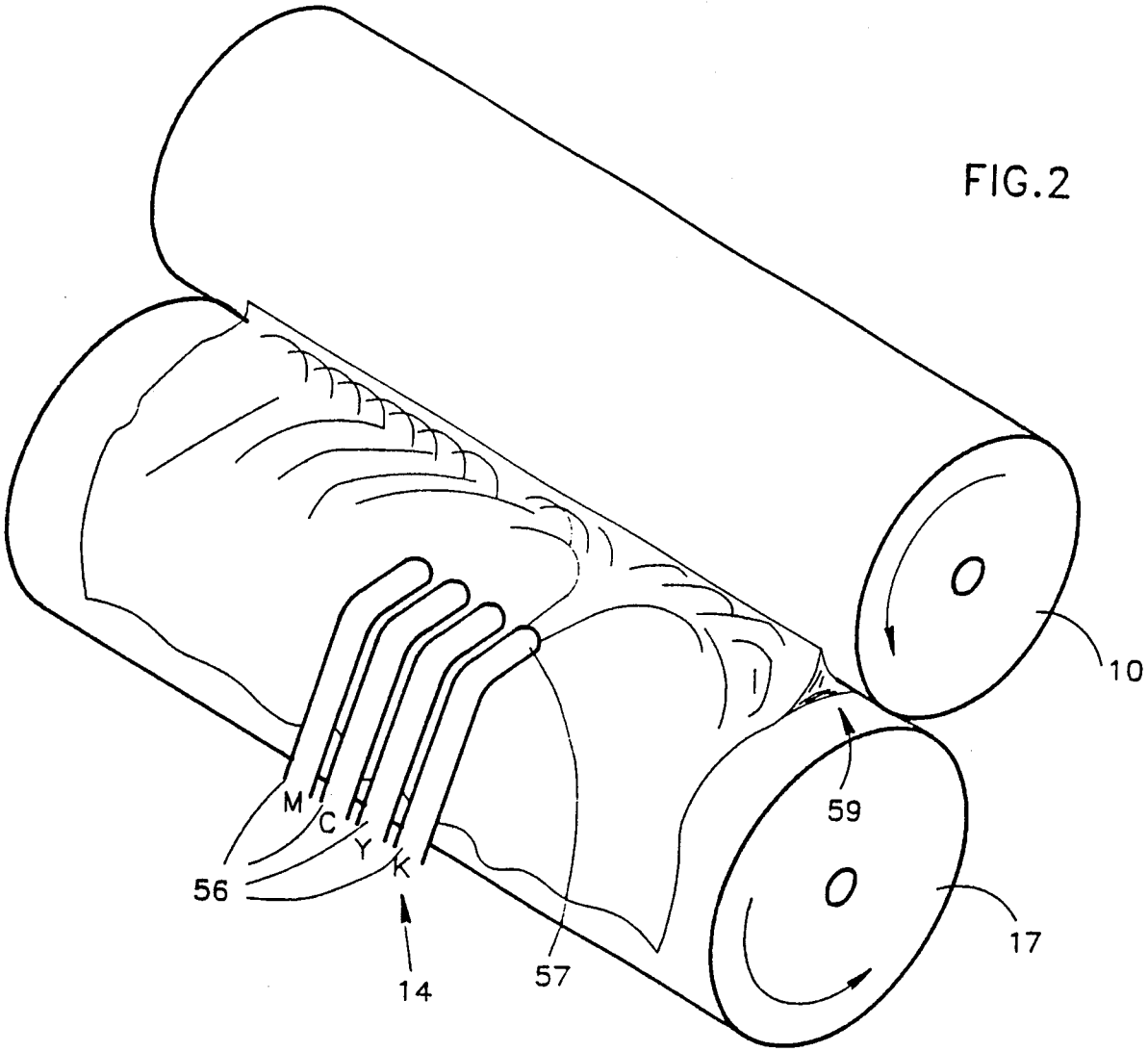
FIG. 2 is a partial perspective view of a preferred embodiment of the apparatus of FIG. 1.
Figure 3:
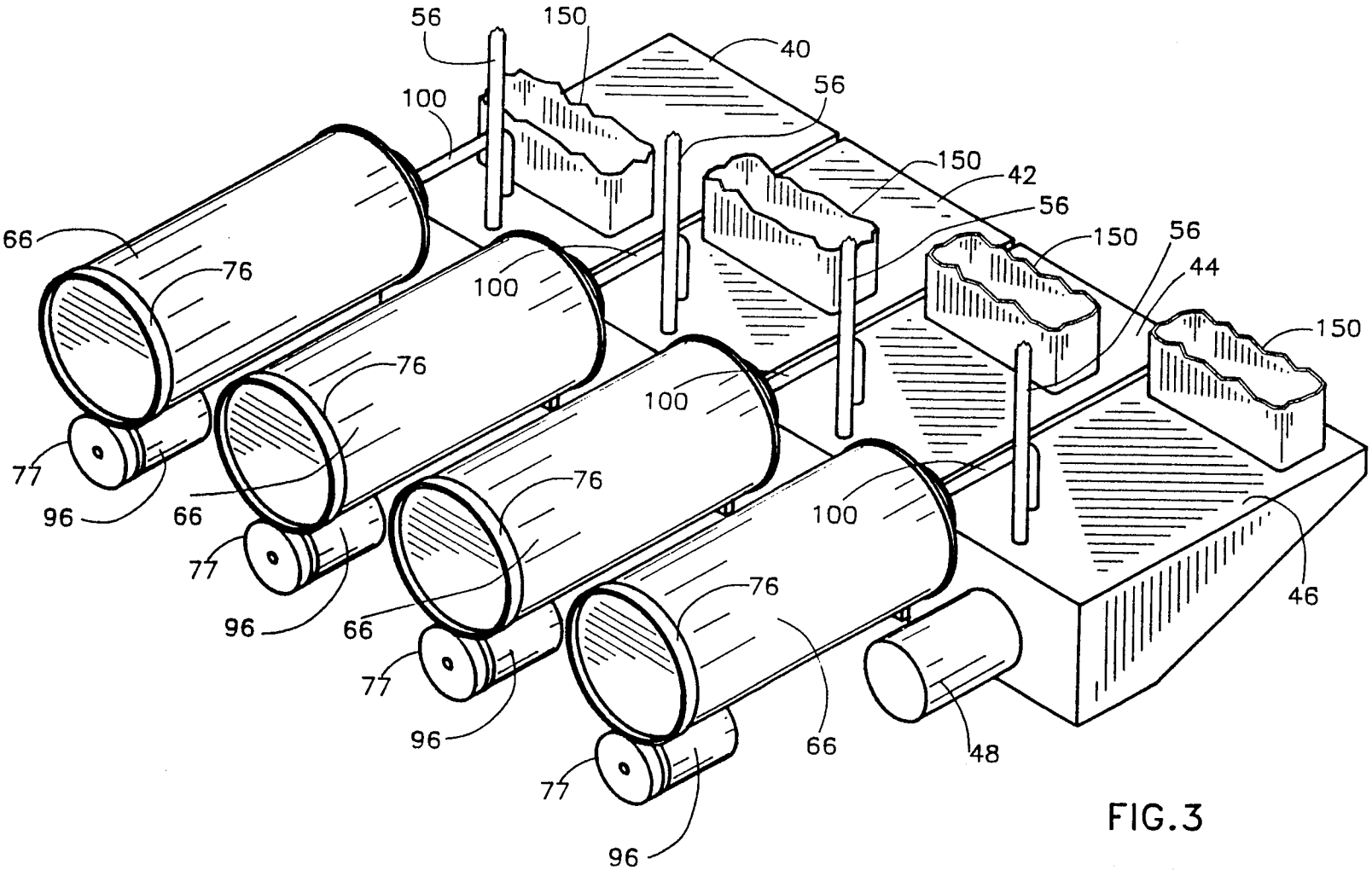
FIG. 3 is a partial perspective view of a preferred embodiment of the apparatus of FIG. 1.

Reference is now made additionally to FIGS. 2 and 3 which are perspective illustrations of parts of the apparatus of FIG. 1. FIG. 2 includes photoconductive drum 10, developer electrode 17 and multicolor supply assembly 14. FIG. 3 shows the lower portion of the apparatus including the arrangement of a plurality of liquid toner reservoirs 40, 42, 44 and 46 and associated apparatus.

Multicolor toner supply assembly 14, receives separate supplies of colored toner from four different reservoirs 40, 42, 44 and 46, typically containing Yellow, Magenta, Cyan and Black liquid toners respectively. Pumps 48 may be provided at the entrances of respective supply conduits 56, for providing a desired amount of pressure to feed the colored toner to multicolor supply assembly 14.

In commonly assigned PCT application PCT/NL90/00069, filed May 14, 1990, the disclosure of which is incorporated herein by reference, a number of multicolor supply assemblies are described each of which includes a plurality of jet nozzles for each color. In the aforementioned PCT application the maximum spacing between nozzles is 8.4 mm. The present inventors have found that, surprisingly, for an effective imaging width at least as large as 8½ inches, only one properly designed stationary supply nozzle 57 is required for each color.

The nozzles of the present invention have a internal diameter of about 3 mm, representing an area about 9 times that of the nozzles of the jet assemblies disclosed in the above mentioned PCT application PCT/NL90/00069. Nozzles 57 are grouped together, one for each color, and are preferably axially centered along developer electrode 17. The stream of liquid developer exiting from the nozzles impinges with a relatively low velocity on developer roller 17 before its region of propinquity with photoconductive drum 10. The velocity is high enough to form an excess of liquid toner at said point of propinquity which corresponds to a development region 59. Surprisingly, it has been found that such a stream spreads along the roller at the region of propinquity as shown in FIG. 2, and provides even development of the latent image. Furthermore, it has been found that the use of a low liquid toner velocity improves the quality of the image formed. The total rate of supply of liquid toner is controlled to form a well defined sheet of liquid toner on developer roller 17, without overflowing the sides of the roller.

Figure 4:
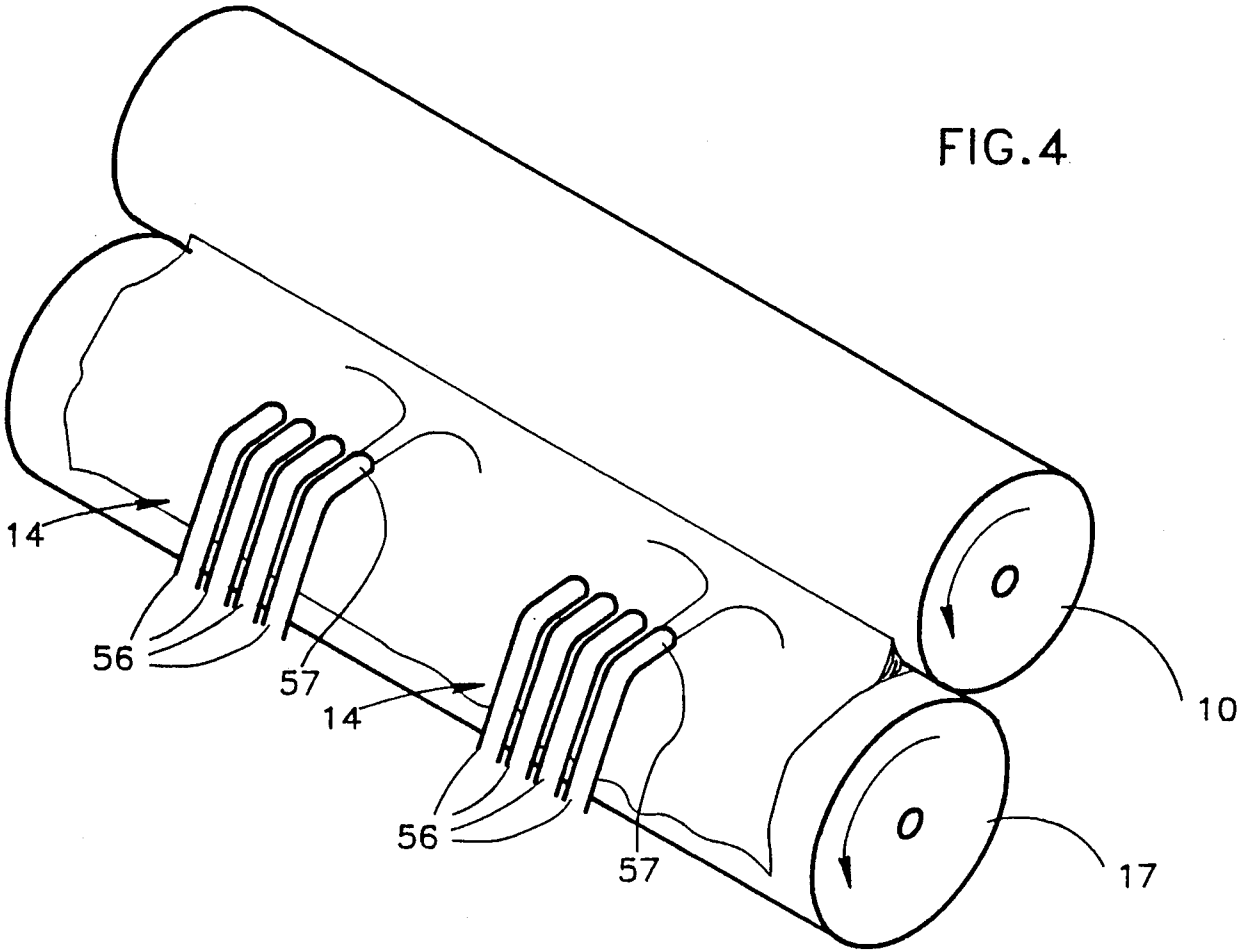
FIG. 4 is a partial perspective view of an alternative preferred embodiment of the apparatus of FIG. 1.

FIG. 4 shows an alternative configuration of nozzles useful for wider imaging areas or for systems in which the toner velocity is further reduced. In this case two sets of nozzles are used to supply developer liquid to the developer roller for development of the latent image. In general the nozzles for a particular color are preferably spaced at a distance greater than 8.4 mm. In particular the preferred spacing is greater than 1 inch and less than 8 inches.

It should be noted in both FIGS. 2 and 4 that the liquid toner preferably is supplied to the region of the developer electrode which is leaving the region of its propinquity with the photoconductive drum 10.

Returning now to FIGS. 1 and 3, color specific toner cleaning assemblies 32 (except for the black assembly) are selectably brought into operative association with developer roller 17 only when toner of a color corresponding thereto is supplied to development region 57 thereon by supply assembly 14. For clarity these cleaning assemblies are not shown in FIGS. 2 and 4. Examples of cleaning assemblies useful in the present invention are shown in the above referenced PCT application.

Each of cleaning assemblies 32 includes a preferably resilient blade member 34. Associated with each of the cleaning assemblies 32 is a toner collection conduit 150 which serves to collect the toner removed by the cleaning assembly 32 from the developing electrode and thus to prevent contamination by mixing of the various colors. Toner conduit 150 returns the removed material to the respective toner reservoir for reinsertion and reuse.

As noted above, the toner collected by cleaning assemblies 32 is recycled to the corresponding toner reservoirs. The black toner collection assembly is always engaged, and any material which may have passed the earlier cleaning assemblies is removed and added to the black reservoir. In practice, little if any material passes blade member 34 of a given cleaning assembly.

It is seen that the toner at the developer interface is removed from the development region quickly after the flow is interrupted. This allows for almost instant change of developer color at development region 59. Additionally developer roller 17 is well cleaned between colors, so that cross-contamination between colors is practically nonexistent.

Figure 6:
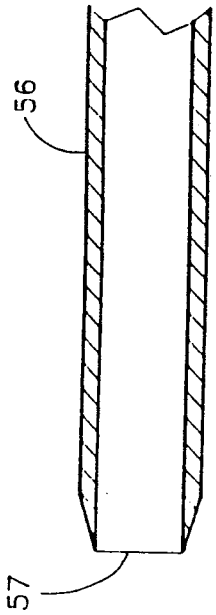
FIG. 6 is a cross-sectional view of a nozzle of the invention.

The outer surfaces of the supply nozzles are tapered at their exit ends, as shown in FIG. 6, in order to reduce the wall thickness at the output face of the extensions to a minimum. It is believed that this reduction reduces dripping of the liquid developer. Except for the configuration and orientation of the nozzles, the toner supply system and cleaning assemblies 32 of the present invention can include any or all of the features of the toner supply systems and cleaning systems described in the above referenced PCT application.

Developer roller 17 is typically maintained at +200 Volts when the voltage of the image areas of the photoconductor 10 is approximately +1000 Volts and the voltage on the background areas of the photoconductor 10 is approximately +100 Volts. The above voltages are suitable for the use of negatively charged toner and a selenium coated photoconductor drum. If it is desired to use a positively charged toner or another type of photoconductor material, correspondingly different voltages will be appropriate.

Figure 5:
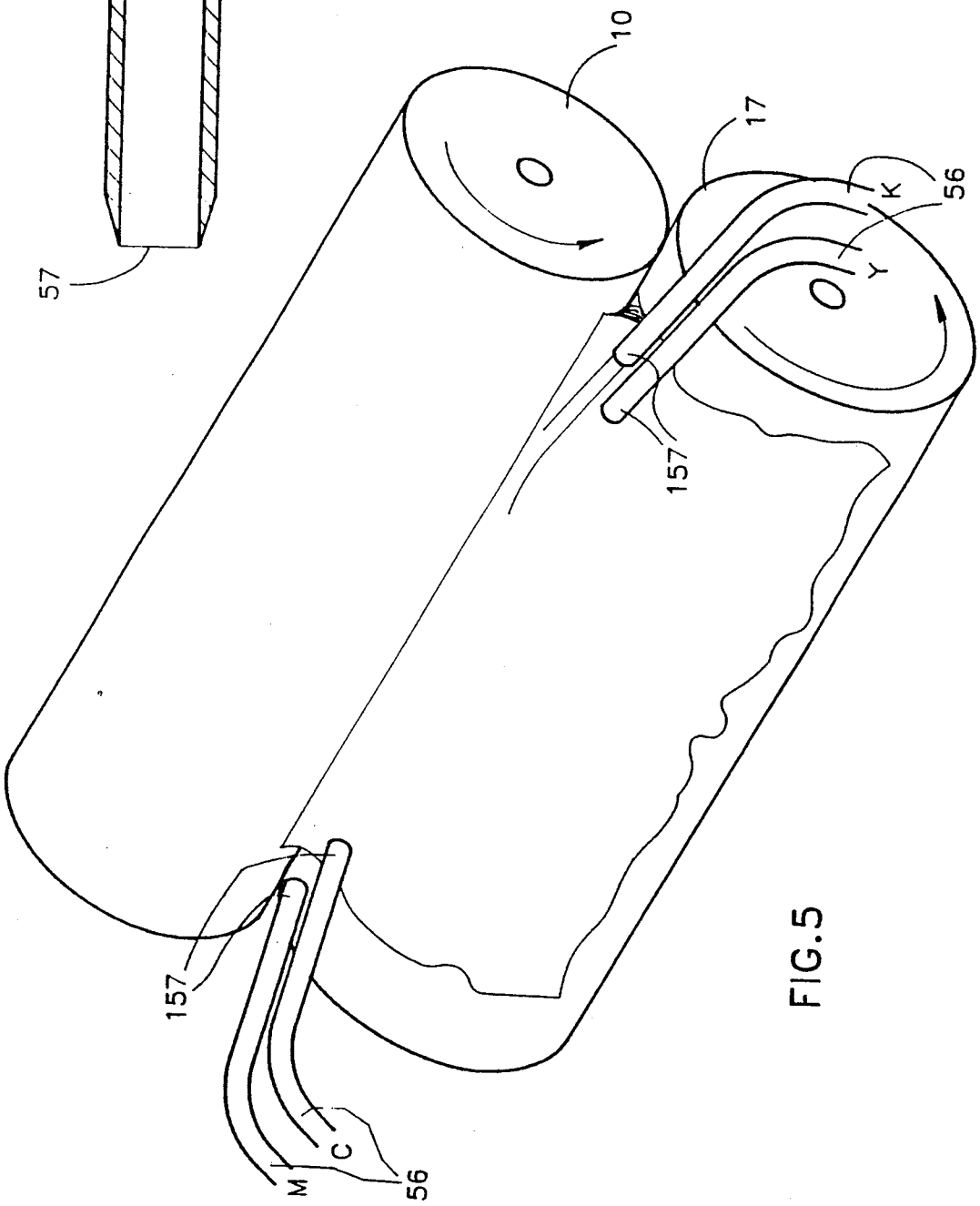
FIG. 5 is a partial perspective view of another preferred embodiment of the apparatus of FIG. 1.

An alternative preferred supply assembly is shown in FIG. 5. In this embodiment of the invention one supply nozzle 157 similar in construction to the nozzles of FIGS. 2 and 4 are provided near the ends of the developer drum for each color and are operative to supply a stream of liquid toner onto developer roller 17 near its center. Nozzles 157 are oriented to provide a component of flow velocity in the direction of development region 59, in order to provide filling of the region with liquid developer. As in the embodiments of FIGS. 2 and 4, the velocity and amount of toner and the angle of the nozzles with the developer roller are adjusted to fill the development region with toner without providing an excess which would run over the ends of roller 17.

An exemplary preferred toner for use in the invention is the toner described in Example 1 of U.S. Pat. No. 4,794,651, the disclosure of which is incorporated herein by reference. For color toners the carbon black is replaced by color pigments as is known in the art. Other liquid toners as known in the art can also be used in the practice of the invention.

Associated with each of reservoirs 40, 42, 44 and 46 are typically provided containers 66 of concentrated toner material. Container 66 is preferably of a construction described in concurrently filed and commonly assigned U.S. patent application entitled LIQUID TONER REPLENISHMENT SYSTEM, Ser. No. 07/570,777 filed Aug. 22, 1990 the disclosure of which is incorporated herein by reference.

In accordance with a preferred embodiment of the invention, containers 66 contain toner concentrate and are operative to add toner particles dispersed in carrier liquid to their respective reservoirs when these have a deficiency of toner particles. Preferably an optical detector 132 in a respective reservoir measures the optical density of the liquid toner therein. When the density is below a first predetermined level, motor 96 is activated by controller 97 and displaces a plunger inside container 66 to transfer a measured amount of toner concentrate from container 66 to its respective toner reservoir thereby to increase the toner particle concentration to the required level.

The optical density of each of the colored toner dispersions is preferably separately measured by an optical density measurement circuit 132. Exemplary forms of such apparatus are shown in U.S. Pat. Nos. 4,579,253 or 4,860,924, the disclosures of which are incorporated herein by reference. A signal responsive to the density is fed into a toner dispenser control system 97 which is operative to activate the motor and to dispense a given amount of toner concentrate from containers 66 into the specific reservoir.

Charge director is preferably included with the toner concentrate in a proper amount.

It will be appreciated by persons skilled in the art that the present invention is not limited to what has been particularly shown and described hereinabove. Rather the scope of the present invention is defined only by the claims which follow:

We claim:

1. Liquid toner imaging apparatus comprising:

an image bearing surface;

means for developing an image on the image bearing surface using a liquid toner including carrier liquid and pigmented particles; and means for transferring a developed image from the image bearing surface to a substrate, wherein the means for developing comprises:

a developer electrode having a movable developer surface whereby portions of the developer surface sequentially come into propinquity with the image bearing surface and subsequently leave propinquity therewith, each portion forming a development region during its propinquity, the developer surface having a given width in the direction perpendicular to its motion; and a single stationary nozzle having a width substantially narrower than the given width of the developer surface, or a plurality of nozzles each of which has a width substantially narrower than the given width of the developer surface, and spaced at least 8.4 mm from each other, for providing liquid toner of a given color to the development region by supplying the liquid toner onto a portion of the development electrode.

2. Apparatus according to claim 1 wherein the nozzle supplies the liquid toner of a given color onto a portion of the developer surface after it leaves the development region.

3. Apparatus according to claim 1 wherein only a single stationary nozzle is provided for supplying liquid toner of a given color.

4. Apparatus according to claim 3 wherein the nozzle supplies a stream of liquid toner having a component of velocity as it leaves the nozzle toward the development region.

5. Apparatus according to claim 4 wherein the stream also has a component of velocity as it leaves the nozzle parallel to the development region.

6. Apparatus according to claim 5 wherein the nozzle is placed near one end of the development region.

7. Apparatus according to claim 1 wherein the developer electrode is situated generally below the image bearing surface.

8. Apparatus according to claim 1 wherein the image bearing surface moves in a given direction at the development region and the developer electrode is a rotating roller spaced from the image bearing surface, and wherein the developer surface moves in a direction opposite to the given direction at the development region.

9. Apparatus according to claim 1 wherein the width of said stationary nozzle is less than 250 mm.

10. Apparatus according to claim 1 wherein the nozzle is spaced more than 250 mm from any other nozzle which supplies liquid toner of the given color to the development region.

11. Apparatus according to claim 1 and also comprises at least two stationary nozzles each spaced between about 250 to 1000 mm from the nearest other nozzle which supplies liquid toner of the given color to the development region.

12. Multi-color liquid toner imaging apparatus comprising:

an image bearing surface;

means for sequentially developing images on the image bearing surface using a plurality of liquid toners each including carrier liquid and pigmented particles of a given color; and means for sequentially transferring a developed image of the given color from the image bearing surface to a substrate, wherein the means for developing comprises:

a developer electrode having a movable developer surface whereby portions of the developer surface sequentially come into propinquity with the image bearing surface and subsequently leave propinquity therewith, each portion forming a development region during propinquity, the developer surface having a given width in the direction perpendicular to its motion; and a single stationary nozzle having a width substantially narrower than the given width of the developer surface, or a plurality of nozzles each of which has a width substantially narrower than the given width of the developer surface, and spaced at least 8.4 mm from each other, for providing liquid toner of a given color to the development region by supplying the liquid toner onto a portion of the development electrode.

13. Apparatus according to claim 12 wherein the nozzle supplies the liquid toner onto a portion of the developer surface after it leaves the development region.

14. Apparatus according to claim 12 wherein only a single stationary nozzle is provided for supplying liquid toner of a given color.

15. Apparatus according to claim 12 wherein the developer electrode is situated generally below the image bearing surface.

16. Apparatus according to claim 12 wherein the image bearing surface moves in a given direction at the development region and the developer electrode is a rotating roller spaced from the image bearing surface, and wherein the developer surface moves in a direction opposite to the given direction at the development region.

17. Apparatus according to claim 12 wherein the width of each stationary nozzle is less than 250 mm.

18. Apparatus according to claim 12 wherein the nozzle is space more than 250 mm from any other nozzle which supplies liquid toner of the given color to the development region.

19. Apparatus according to claim 12 and also comprises at least two stationary nozzles each spaced between about 250 to 1000 mm from the nearest other nozzle which supplies liquid toner of the given color to the development region.

20. Liquid toner imaging apparatus comprising:

an image bearing surface;

means for developing an image on the image bearing surface using a liquid toner including carrier liquid and pigmented particles; and means for transferring a developed image from the image bearing surface to a substrate, wherein the means for developing comprises:

a developer electrode having a movable developer surface whereby portions of the developer surface sequentially come into propinquity with the image bearing surface and subsequently leave propinquity therewith, each portion forming a development region during propinquity, the developer surface having a given width in the direction perpendicular to its motion; and a single stationary nozzle having a width substantially narrower than the given width of the developer surface for supplying liquid toner of a given color to said development region by supplying toner onto the developer electrode.

21. Apparatus according to claim 20 wherein the nozzle supplies the liquid toner to a portion of the developer surface after it leaves the development region.

22. Apparatus according to claim 21 wherein the nozzle supplies a stream of liquid toner having a component of velocity as it leaves the nozzle toward the development region.

23. Apparatus according to claim 22 wherein the stream also has a component of velocity as it leaves the nozzle parallel to the development region.

24. Apparatus according to claim 23 wherein the nozzle is placed near one end of the development region.

25. Apparatus according to claim 20 wherein the developer electrode is situated generally below the image bearing surface.

26. Apparatus according to claim 20 wherein the image bearing surface moves in a given direction at the development region and the developer electrode is a rotating roller spaced from the image bearing surface, wherein the developer surface moves in a direction opposite to the given direction at the development region.

27. Apparatus according to claim 20 wherein the nozzle supplies a stream of liquid toner having a component of velocity as it leaves the nozzle toward the development region.

28. Apparatus according to claim 27 wherein the stream also has a component of velocity as it leaves the nozzle parallel to the development region.

29. Apparatus according to claim 28 wherein the nozzle is placed near one end of the development region.

30. Apparatus according to claim 20 wherein the width of said stationary nozzle is less than 250 mm.

31. Liquid toner imaging apparatus comprising:

an image bearing surface;

means for developing an image on the image bearing surface using a liquid toner including carrier liquid and pigmented particles; and means for transferring a developed image from the image bearing surface to a substrate, wherein the means for developing comprises:

a single developer electrode having a movable developer surface whereby portions of the developer surface sequentially come into propinquity with the image bearing surface and subsequently leave propinquity therewith, each portion forming a development region during its propinquity, the developer surface having a given width in the direction perpendicular to its motion; and a single stationary nozzle having a width substantially narrower than the given width of the developer surface, or a plurality of nozzles each of which has a width substantially narrower than the given width of the developer surface, and spaced at least 8.4 mm from each other for providing liquid toner of a given color to the development region.

32. Apparatus according to claim 31 wherein the width of said stationary nozzle is less than 250 mm.

33. Apparatus according to claim 31 wherein the nozzle is spaced more than 250 mm from any other nozzle which supplies liquid toner of the given color to the development region.

34. Apparatus according to claim 31 and also comprises at least two stationary nozzles each spaced between about 250 to 1000 mm from the nearest other nozzle which supplies liquid toner of the given color to the development region.

* * * * *